US007036345B2

(12) United States Patent
Satou et al.

(10) Patent No.: US 7,036,345 B2
(45) Date of Patent: May 2, 2006

(54) METHOD OF MONITORING RAM SPEED OF PRESS BRAKE, PRESS BRAKE USING THE METHOD, AND METHOD AND APPARATUS FOR CONTROLLING RAM POSITION OF PRESS BRAKE

(75) Inventors: Masutaka Satou, Kanagawa (JP); Kazuhiro Kanno, Kanagawa (JP)

(73) Assignee: Amada Company, Limited, Kanagawa (JP)

( * ) Notice: Subject to any disclaimer, the term of this patent is extended or adjusted under 35 U.S.C. 154(b) by 520 days.

(21) Appl. No.: 10/169,746

(22) PCT Filed: Jan. 16, 2001

(86) PCT No.: PCT/JP01/00219

§ 371 (c)(1),
(2), (4) Date: Jul. 17, 2002

(87) PCT Pub. No.: WO01/53016

PCT Pub. Date: Jul. 26, 2001

(65) Prior Publication Data

US 2003/0000279 A1 Jan. 2, 2003

(30) Foreign Application Priority Data

Jan. 17, 2000 (JP) ..... 2000-008314
Jan. 27, 2000 (JP) ..... 2000-019096

(51) Int. Cl.
*B30B 15/20* (2006.01)
*B30B 1/34* (2006.01)
*B21D 5/02* (2006.01)

(52) U.S. Cl. ..... 72/20.1; 72/21.4; 72/31.1; 72/31.11; 72/389.4; 72/389.6; 100/257; 364/476

(58) Field of Classification Search ..... 72/20.1, 72/20.4, 21.1, 21.3, 443, 17.5, 11, 12, 19.1, 72/31.1, 31.11, 389.4, 389.6, 446; 100/257; 29/753; 364/476
See application file for complete search history.

(56) References Cited

U.S. PATENT DOCUMENTS 5,031,431 A * 7/1991 Naito ..... 72/21.5
5,069,060 A * 12/1991 Ishii ..... 72/443
5,669,257 A * 9/1997 Inoue et al. ..... 72/20.1
5,727,409 A * 3/1998 Inoue et al. ..... 72/21.1
6,240,758 B1 * 6/2001 Nagakura ..... 72/20.1

FOREIGN PATENT DOCUMENTS

JP 4157022 5/1992
JP 8168897 7/1996
JP 10180499 7/1998
JP 10203755 8/1998

* cited by examiner

*Primary Examiner*—David Jones
(74) *Attorney, Agent, or Firm*—Greenblum & Bernstein, P.L.C.

(57) ABSTRACT

A vertical position of a ram is directly detected by a ram position detector. A first speed arithmetic operating portion determines a first ram moving speed on the basis of a change of the detected position. A second speed arithmetic operating portion determines a second ram moving speed on the basis of a rotational number of a servo motor which is determined by a servo motor rotational number detector. A comparing portion compares the first ram speed with the second ram speed, and when a difference is equal to or more than a predetermined amount, a judging portion judges that an abnormality exists so as to immediately stop the servo motor and stop an operation.

8 Claims, 8 Drawing Sheets

METHOD OF MONITORING RAM SPEED OF PRESS BRAKE, PRESS BRAKE USING THE METHOD, AND METHOD AND APPARATUS FOR CONTROLLING RAM POSITION OF PRESS BRAKE

TECHNICAL FIELD

This invention relates to a ram speed monitoring method. The ram speed monitoring method includes moving a ram vertically by moving a hydraulic cylinder vertically using a two-way fluid pump. This invention also relates to a press brake which uses the ram speed monitoring method. This invention further relates to a ram position control method in a press brake. The ram position control method includes executing a bending process by vertically moving an upper table or a lower table which corresponds to a ram. This invention also relates to a ram position controller which uses the ram position control method.

BACKGROUND ART

In a hydraulic circuit in a press brake according to the prior art, an upper cylinder chamber and a lower cylinder chamber in a hydraulic cylinder are respectively connected to a switch valve via piping. The hydraulic cylinder moves a ram. For example, an upper table or the like are respectively connected to a switch valve via piping. However, since an opening degree of the switch valve and a supply flow amount (to the upper cylinder chamber and the lower cylinder chamber in the hydraulic cylinder) are not in a linear relationship, it is impossible to monitor a speed on the basis of the opening degree of the switch valve. Accordingly, the ram speed is monitored only by a ram sensor. Therefore, there has been a problem that the ram speed cannot be corrected if the ram sensor is out of order.

This invention has been made with consideration to the problem in the prior art mentioned above, and an object of this invention is to provide a safer ram speed monitoring method and a press brake which uses the ram speed monitoring method.

Another object of this invention is to provide a ram position control method and a ram position controller which can position a ram at a position with no relationship to a pressure and a temperature of a working fluid supplied from a hydraulic pump to a hydraulic cylinder.

DISCLOSURE OF THE INVENTION

In order to achieve the object mentioned above, according to a first aspect of the present invention, there is provided a ram speed monitoring method in a press brake. The ram speed monitoring method includes moving a ram vertically by moving a hydraulic cylinder vertically according to a rotational direction of a two-way fluid pump. A first ram moving speed is determined on the basis of a change of ram position by directly detecting a position of the ram using a ram position detector. A rotational number of a servo motor which rotates and drives the two-way fluid pump is detected. An amount of a working fluid discharged from the two-way fluid pump is computed on the basis of the rotational number. A second ram moving speed is computed on the basis of a moving speed of the hydraulic cylinder which moves the ram. The first ram moving speed is compared with the second ram moving speed. The ram speed monitoring method includes judging when the speeds are different by a predetermined amount so as to control the servo motor to immediately stop a working. A bending process is carried out according to the ram speed monitoring method.

Therefore, in the ram speed monitoring method, the vertical position of the ram is directly detected and the first ram moving speed is determined on the basis of the change of the detected position. The second ram moving speed is determined by computing the amount of the working fluid supplied to the hydraulic cylinder in which the two-way fluid pump moves the ram. Accordingly, when the difference is at least the predetermined amount, the servo motor is immediately stopped and the working is stopped. Accordingly, even in the case that an accurate ram moving speed cannot be determined in one path, it is possible to secure a safety of operation.

According to a second aspect of the present invention, there is provided a press brake using a ram speed monitoring method. The press brake includes a ram capable of moving vertically and a hydraulic cylinder that moves the ram vertically. The press brake also includes a two-way fluid pump that operates the hydraulic cylinder so as to move the ram vertically. The two-way fluid pump moves the ram vertically by switching a rotational direction. A ram position detector detects a vertical position of the ram. A servo motor rotational number detector detects a rotational number of a servo motor which rotates and drives the two-way fluid pump. A controller controls the servo motor. The controller includes a first speed arithmetic operating portion that computes a first ram moving speed on the basis of a position signal output from the ram position detector. The controller also includes a second speed arithmetic operating portion that computes a second ram moving speed on the basis of a signal output from the servo motor rotational number detector. A comparing portion compares the first ram moving speed with the second ram moving speed, and a judging portion judges that an aberration is generated in the case that the ram moving speeds are different by a predetermined amount as a result of the comparison carried out by the comparing portion. The servo motor is stopped based on the results of the judging portion.

Accordingly, the vertical position of the ram is directly detected by the ram position detector and the first ram moving speed is determined on the basis of the change of the detected position by the first speed arithmetic operating portion. At the same time, the rotational number of the servo motor is determined by the servo motor rotational number detector for the purpose of determining the amount of the working fluid supplied from the two-way fluid pump to the hydraulic cylinder which moves the ram vertically. The vertical moving speed of the ram is determined by the second speed arithmetic operating portion on the basis of the rotational number of the servo motor. Accordingly, the comparing portion compares the first ram speed and the second ram speed which are determined on the basis of the different paths. In the case that a difference is at least the predetermined amount, the judging portion judges that the abnormality occurs and immediately stops the servo motor. Accordingly, even in the case that an accurate ram moving speed cannot be determined in one path, it is possible to secure safety in the operation.

According to a third aspect of the present invention, there is provided a ram position control method in a press brake comprising. The method includes operating a hydraulic pump by a servo motor. A ram is moved vertically by using a hydraulic cylinder operated by a working fluid supplied from the hydraulic pump. The servo motor is rotated on the basis of a position command. A position signal output from a ram position detector is fed back. A position compensation value is determined on the basis of a previously-obtained relationship of a deviation amount of the ram position with respect to a pressure and an oil temperature in the hydraulic cylinder. The position command is corrected so as to rotate the servo motor. A bending process is applied to a work on the basis of a cooperation between a punch and a die which are provided in the ram.

Therefore, the hydraulic pump is operated by rotating the servo motor according to the position command, and the ram is moved vertically by supplying the working fluid to the hydraulic cylinder. A height position of the ram is detected by the ram position detector and is fed back. Further, the pressure and the oil temperature of the working fluid in the hydraulic cylinder are detected, and the position compensation amount is determined on the basis of the previously-obtained relationship of the deviation amount of the ram position with respect to the pressure and the oil temperature. Then the corrected position command is output to the servo motor. Therefore, it is possible to accurately position the ram at a predetermined position without relationship to the pressure and the oil temperature of the working fluid.

According to a fourth aspect of the present invention, there is provided a ram position controller in a press brake. The ram position controller includes a servomotor and a hydraulic pump that operates the servo motor. A hydraulic cylinder is operated by a working fluid supplied from the hydraulic pump. A ram is moved vertically by the hydraulic cylinder. A punch and a die are provided in the ram. The punch and die cooperate to apply a bending process to a work. A position command portion commands a position of the ram. A ram position detector detects and feeds back the position of the ram. A memory stores a relationship between a pressure and an oil temperature in the hydraulic cylinder and a ram position deviation amount. A pressure sensor is provided in the hydraulic cylinder. An oil temperature sensor is also provided in the hydraulic cylinder. A monitoring portion monitors the pressure and the oil temperature from the pressure sensor and the oil temperature sensor. A ram position deviation amount is determined according to the stored relationship between the pressure and the oil temperature in the hydraulic cylinder and the ram position deviation amount. The ram position deviation amount is used to correct the position command.

Therefore, the servo motor is rotated and the hydraulic pump is operated according to the position command output from the position command portion, and the working fluid is supplied to the hydraulic cylinder to move the ram vertically. The height position of the ram is detected and fed back by the ram position detector. Further, the oil temperature of the working fluid is detected by the oil temperature sensor, and the pressure of the working fluid in the hydraulic cylinder is detected by the pressure sensor. The monitoring portion monitors the pressure and the oil temperature, and determines the position compensation amount on the basis of the previously-stored relationship between the deviation amount of the ram position and the pressure and the oil temperature. The monitoring portion corrects the position command to the servo motor. Therefore, it is possible to accurately position the ram at a predetermined position without relationship to the pressure and the oil temperature of the working fluid.

BEST MODE FOR CARRYING OUT THE INVENTION

Figure 1:
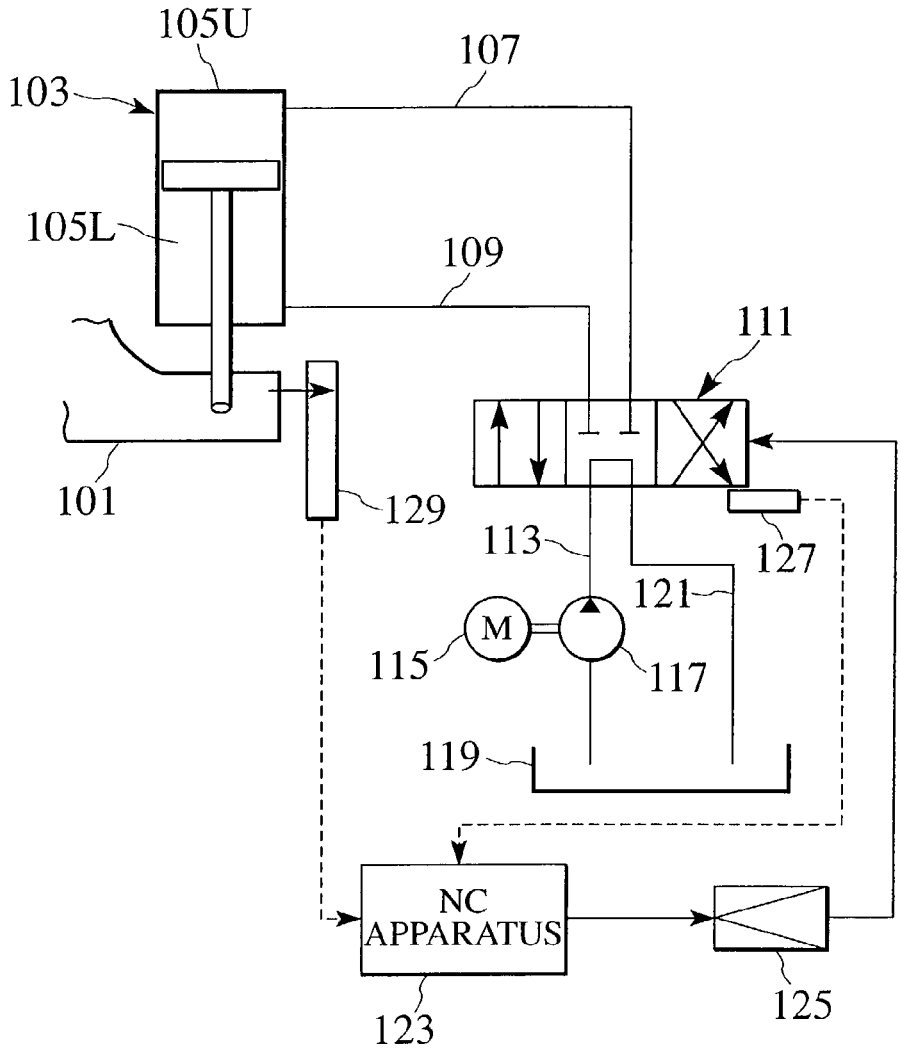
FIG. 1 is a view of a hydraulic circuit of a press brake, according to an exemplary embodiment of the present invention.

FIG. 1 shows a hydraulic circuit in a press brake according to a first embodiment of the present invention. In this hydraulic circuit, a hydraulic cylinder 103 moves a ram 101. An upper cylinder chamber 105U and a lower cylinder chamber 105L are provided in the hydraulic cylinder 103. The upper cylinder chamber 105U and the lower cylinder chamber 105L are connected to a switch valve 111 respectively via pipes 107 and 109.

This switch valve 111 is connected to an oil tank 119 via a hydraulic pump 117 rotated by a motor 115 through a pipe 113, and is directly connected to the oil tank 119 through a pipe 121. Further, the switch valve 111 is controlled by amplifying a control signal output from an NC apparatus 123 by an amplifier 125, and a moving state (that is, an opening degree) of the switch valve 111 is detected by a position sensor 127 so as to be fed back to the NC apparatus 123, whereby a servo system is constructed.

A ram sensor 129 detects a vertical movement of the ram 101, and this ram sensor 129 is connected to the NC apparatus 123.

Accordingly, a control signal output from the NC apparatus 123 is amplified by the amplifier 125 so as to be fed to the switch valve 111, thereby switching an upward movement, a stop and a downward movement of the hydraulic cylinder 103 and performing an upward movement, a stop and a downward movement of the ram 101. That is, in a position shown in FIG. 5 of the switch valve 111, since the working fluid supplied from the hydraulic pump 117 is directly returned to the oil tank 119 via the switch valve 111, the hydraulic cylinder 103 and the ram 101 are stopped.

Further, when moving the switch valve 111 in a right direction in FIG. 1, the working fluid supplied from the hydraulic pump 117 is supplied to the lower cylinder chamber 105L of the hydraulic cylinder 103 via the pipe 109. The working fluid in the upper cylinder chamber 105U is returned to the oil tank 119 via the pipes 107 and 121, so that the ram 101 moves upward. An upward moving speed of the ram 101 is changed in correspondence to a discharge amount from the hydraulic pump 117, that is, an opening degree of the switch valve 111.

Figure 5:
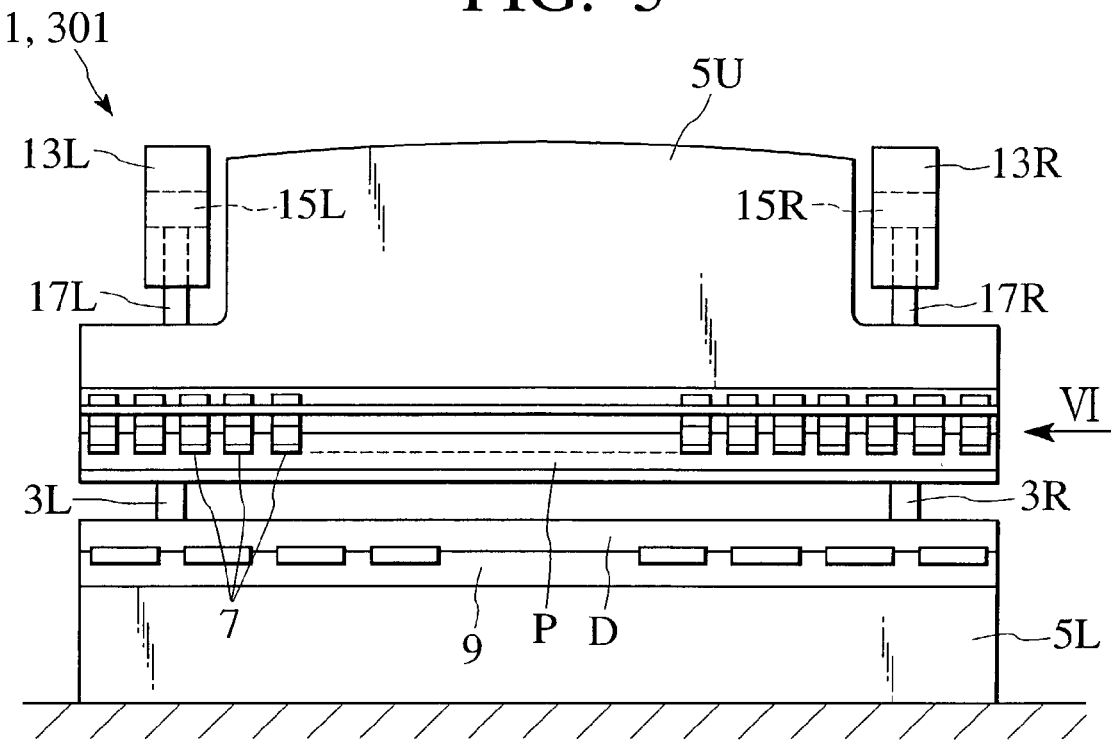
FIG. 5 is a front elevational view showing a whole of a press brake to which a ram position control method using a hydraulic cylinder is applied, according to an exemplary embodiment of the present invention.

Further, when moving the switch valve 111 in a left direction in FIG. 5, the working fluid supplied from the hydraulic pump 117 is supplied to the upper cylinder chamber 105U of the hydraulic cylinder 103 via the pipe 107, and the working fluid in the lower cylinder chamber 105L is returned to the oil tank 119 via the pipes 109 and 121, so that the ram 101 moves downward. A downward moving speed of the ram 101 is changed in correspondence to the discharge amount from the hydraulic pump 117, that is, the opening degree of the switch valve 111.

In this case, a state of the upward movement and the downward movement in the ram 101 is detected by the ram sensor 129 so as to be sent to the NC apparatus 123, and the NC apparatus 123 monitors the position of the ram 101 on the basis of the detection signal.

Figure 3:
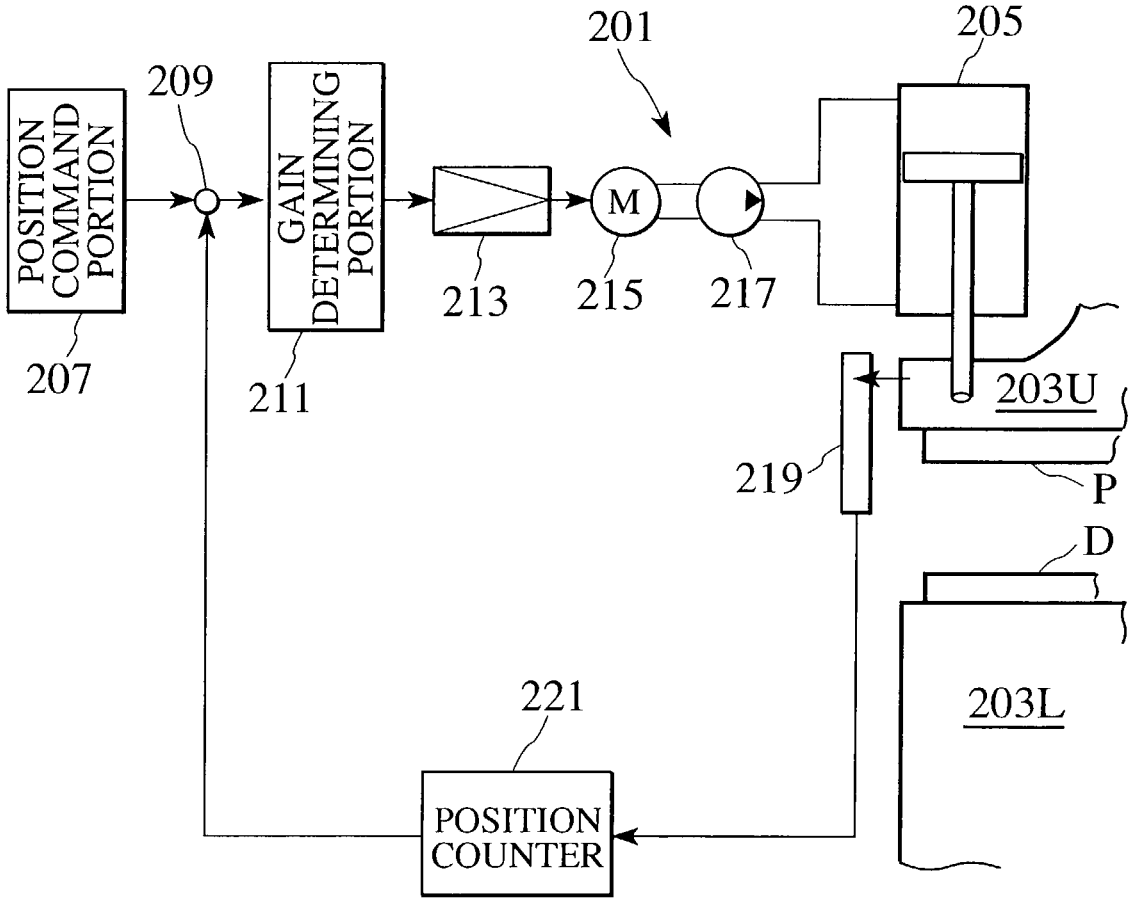
FIG. 3 is a view of a hydraulic circuit of a press brake according to an exemplary embodiment of the present invention.

FIG. 3 shows a flow of a ram position control in a press brake 201 according to a second embodiment. This press brake 201 moves an upper table 203U vertically by a hydraulic cylinder 205. The press brake 201 applies a bending process to a work in cooperation with a die D attached to a lower table 203L.

That is, a position command output from a position command portion 207 is sent to a gain determining portion 211 via an adder 209. The gain determining portion 211 determines a ram motion gain, and amplifies the command by an amplifier 213 so as to output the command to a servo motor 215. A hydraulic pump 217 is operated by the servomotor 215, and the hydraulic cylinder 205 is moved vertically so as to move the upper table 203U vertically.

Further, a vertical position of the upper table 203U is detected by a ram position detector 219, and is fed back to the adder 209 via a position counter 221, thereby constituting a servo loop.

Next, a description will be given of a third embodiment according to the present invention. The third embodiment corresponds to an improvement of the first embodiment.

Figure 2:
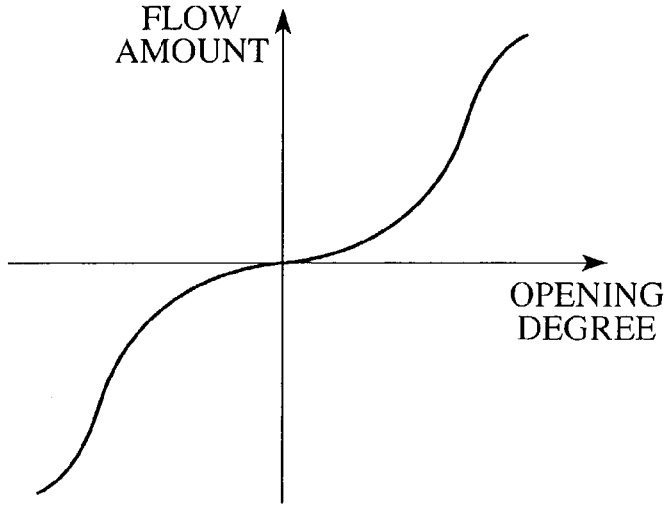
FIG. 2 is a graph showing a relationship between an opening degree of a switch valve in the press brake and a supplied working fluid amount, according to an exemplary embodiment of the present invention.

That is, in the first embodiment, since the opening degree of the switch valve 111 and the supply flow amount to the hydraulic cylinder 103 are not in the linear relationship as shown in FIG. 2, it is not possible to monitor the speed on the basis of the opening degree of the switch valve 111. Accordingly, the ram speed is monitored only by the ram sensor 129. Therefore, when the ram sensor 129 is out of order, there is a problem that it is impossible to correct the ram speed.

Accordingly, a description will be given below of the third embodiment which improves the problem mentioned above.

Figure 6:
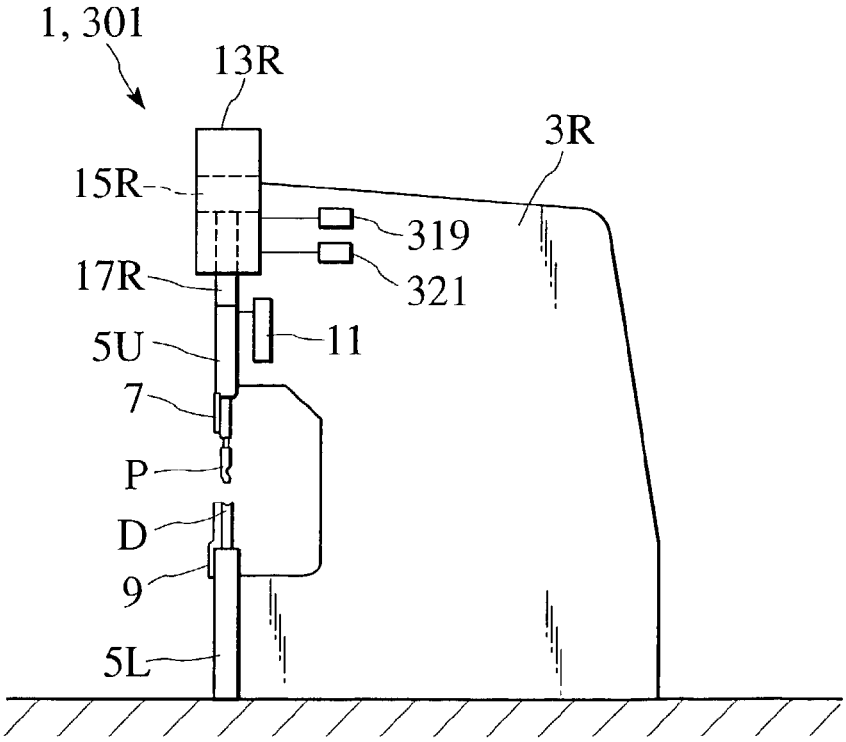
FIG. 6 is a side elevational view as seen from a direction VI in FIG. 5.

FIGS. 5 and 6 show a press brake 1 according to this invention. This press brake 1 has side plates 3L and 3R provided in left and rights sides in a standing manner. The press brake 1 has an upper table 5U on upper front end surfaces of the side plates 3L and 3R in such a manner as to be capable of moving vertically. The press brake 1 is provided with a lower table 5L on lower front surfaces of the side plates 3L and 3R.

A punch P is provided in a lower end portion of the upper table 5U via a plurality of intermediate plates 7. Further, a die D is provided in a die holder 9 which is provided in an upper end portion of the lower table 5L.

In this case, a linear scale 11 is provided as a ram position detector for measuring a height position of the upper table 5U. The linear scale 11 determines an interval with respect to the die D on the basis of a height of the punch P so as to judge whether the bending process is finished and detect a bending angle.

Hydraulic cylinders 13L and 13R are respectively provided in upper front surfaces of the left and right side plates 3L and 3R. The upper table 5U is mounted to front ends (lower ends) of piston rods 17L and 17R which are attached to pistons 15L and 15R of the hydraulic cylinders 13L and 13R.

Next, a description will be given of a hydraulic circuit with respect to the hydraulic cylinders 13L and 13R with reference to FIG. 7. In this case, since the same hydraulic circuit is provided in the left and right hydraulic cylinders 13L and 13R, the following description will be given of the right hydraulic cylinder 13R and the right hydraulic circuit.

An upper cylinder chamber 19U of the hydraulic cylinder 13R moves the upper table 5U vertically. The upper cylinder chamber 19U is connected to a prefill valve 23 through a pipe 21, and is further connected to an oil tank 27 through a pipe 25.

Further, the upper cylinder chamber 19U is connected to one side of a two-way piston pump 31 through a pipe 29. A pipe 33 is connected to the pipe 29 in the middle thereof, and is connected to the oil tank 27 via a check valve 35 and a suction filter 37.

In this case, the two-way fluid pump 31 is rotated and driven by an AC servo motor 39 which is controlled by an NC apparatus 18 controller. An encoder 40 corresponding to a servo motor rotational number detector is mounted to the AC servo motor 39, and the structure is made such that a rotational state is detected so as to be transmitted to the NC apparatus 18.

A pipe 41 is connected to the lower cylinder chamber 19L of the hydraulic cylinder 13R, and a counter balance valve 43 and a sequence switch valve 45 corresponding to an electromagnetic poppet valve are provided in parallel. The counter balance valve 43 and the sequence switch valve 45 are connected to another side of the two-way piston pump 31 through a pipe 47. Further, a pipe 49 is connected to the pipe 47 in the middle thereof, and this pipe 49 is connected to the oil tank 27 via a check valve 51 and a suction filter 53.

Further, a throttle valve 55 and a high-pressure preference type shuttle valve 57 are provided between the pipe 41 and the pipe 29. A pipe 59 is connected to a discharge side of the high pressure preference type shuttle valve 57. A relief valve 61 is provided in the pipe 59, and a pipe 63 is connected to the oil tank 27.

In the NC apparatus 18, a first speed arithmetic operating portion 65 computes a ram moving speed on the basis of a change of a ram position signal with respect to a unit time output from the linear scale 11. A second speed arithmetic operating portion 67 computes a rotational number of the two-way piston pump 31 on the basis of a signal output from the encoder 40 mounted to the AC servo motor 39 so as to compute a ram moving speed.

Figure 8:
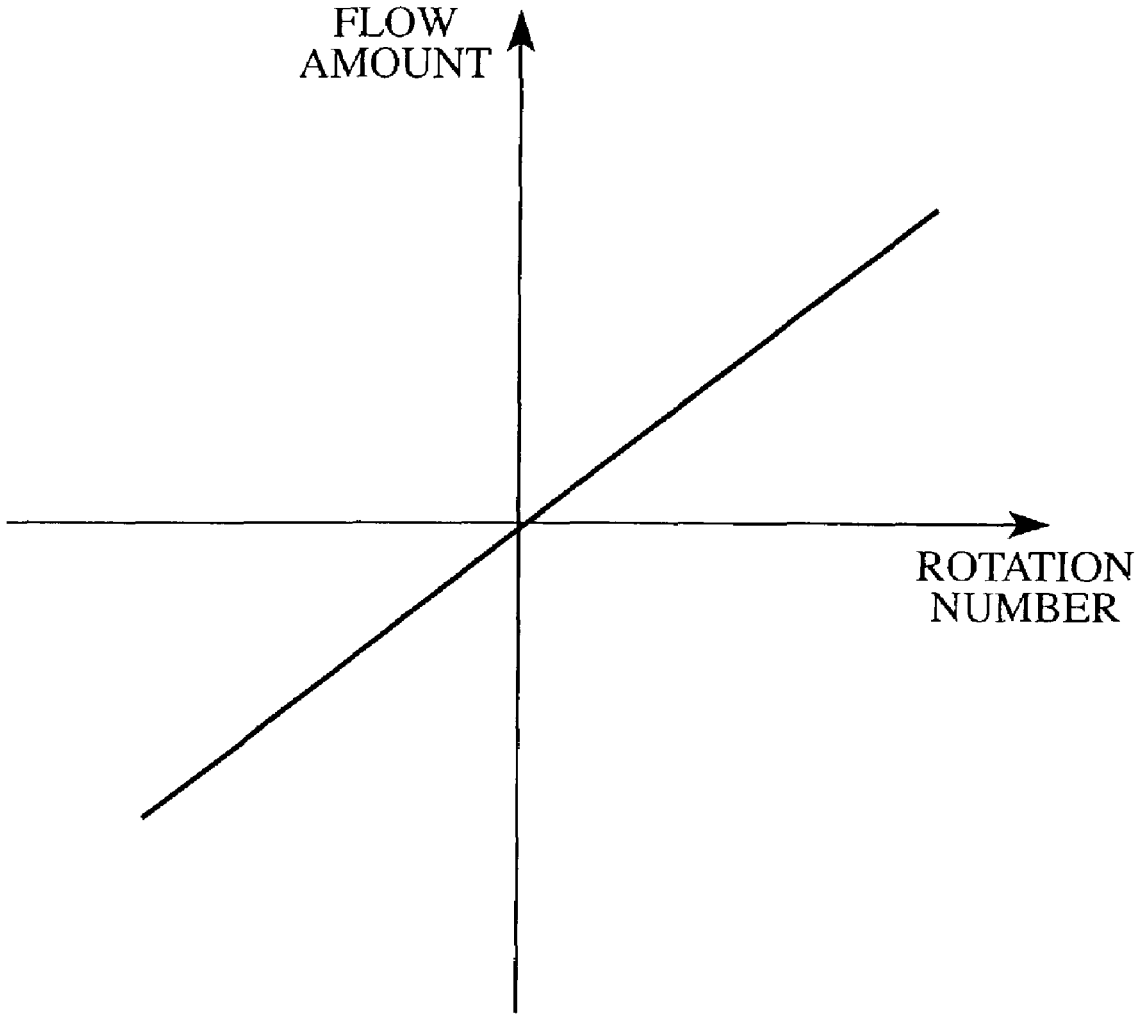
FIG. 8 is a graph showing a relationship between a rotational number of a servo motor and a ram moving speed.

In the second speed arithmetic operating portion 67, since a flow amount of the working fluid supplied by the two-way piston pump 31 is in proportion to the rotational number of the two-way piston pump 31 as shown in FIG. 8, the ram moving speed is computed by computing the flow amount of the working fluid supplied at the unit time.

The first speed arithmetic operating portion 65 and the second speed arithmetic operating portion 67 are connected to a comparing portion 69. The independently computed ram moving speeds are compared in the comparing portion 69, so that, for example, in the case that a difference between both of the ram moving speeds is larger than a preset allowable value, a judging portion 71 judges that an abnormality exists, and outputs a stop signal to the AC servo motor 39 so as to stop the working.

According to the structure mentioned above, in the case of rapidly moving the upper table 5U downward due to its own weight, and by means of the hydraulic cylinder 13R, from a state in which the working fluid is charged in the upper cylinder chamber 19U and the lower cylinder chamber 19L, the two-way piston pump 31 is stopped and the piston 19R is in a top dead center. The pipe 41 is communicated with the pipe 47 by switching the sequence switch valve 45, and the two-way piston pump 31 is rotated by the AC servo motor 39.

The position of the upper table 5U is measured by the linear scale 11 so as to be sent to the first speed arithmetic operating portion 65 of the NC apparatus 18, whereby the moving speed of the upper table 5U is computed. At the same time, the encoder 40 transmits the rotation of the AC servo motor 39 to the second speed arithmetic operating portion 67 of the NC apparatus 18, and the second speed arithmetic operating portion 67 computes the moving speed of the piston 15. That is, the moving speed of the upper table 5U is computed on the basis of an amount of the working fluid supplied to the upper cylinder chamber 19U of the hydraulic cylinder 13R by the two-way piston pump 31.

The comparing portion 69 compares two moving speeds of the upper table 5U. In the case that the difference is equal to or more than a predetermined amount, the judging portion 71 judges that the abnormality occurs, stops the AC servo motor 39 and stops the movement of the upper table 5U.

Figure 7:
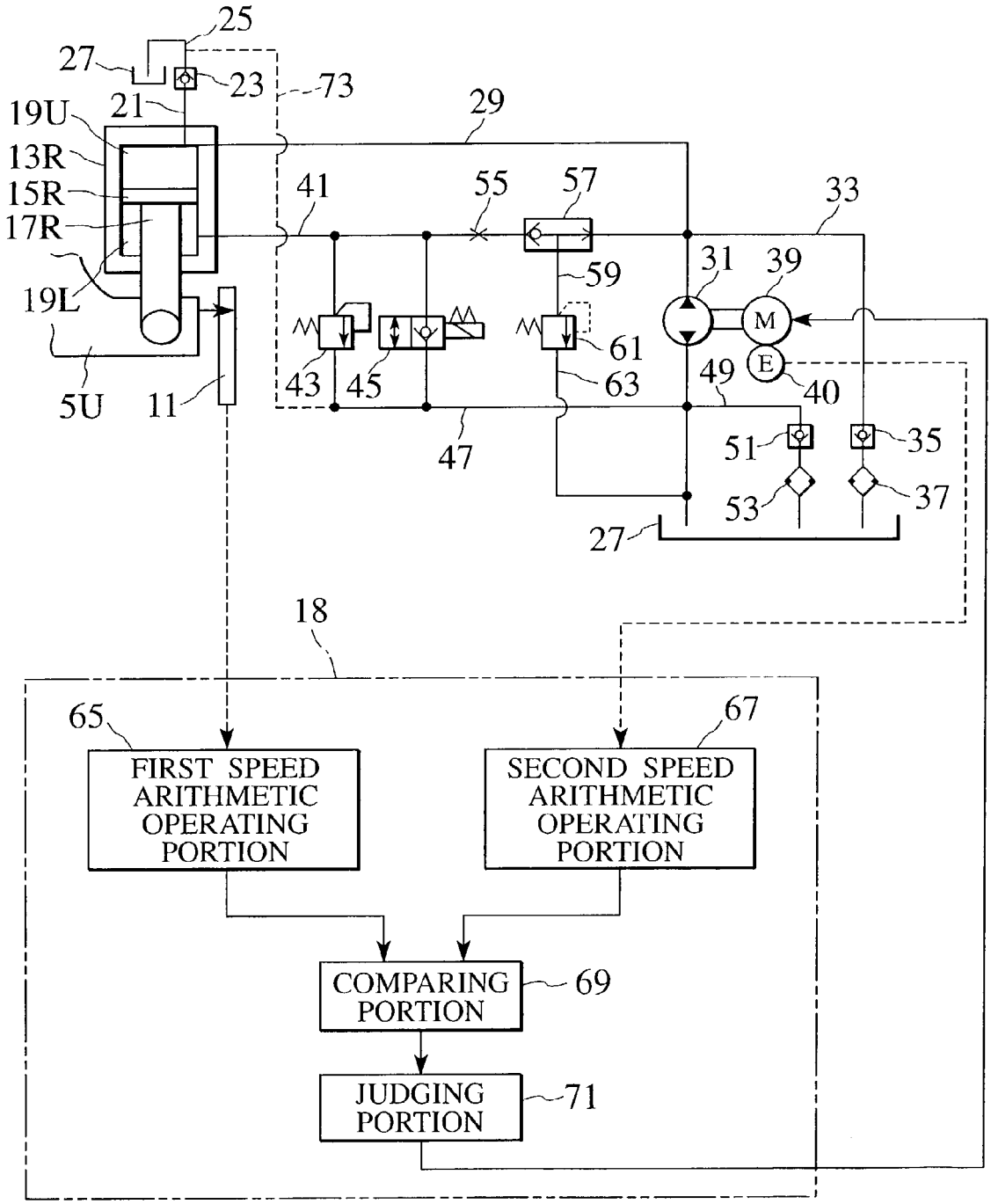
FIG. 7 is a hydraulic circuit diagram of the press brake and a block diagram showing a structure of an NC apparatus, according to an exemplary embodiment of the present invention.

In the case of moving further downward so as to execute the bending process, the sequence switch valve 45 is set to a state shown in FIG. 7, and the working fluid supplied from the lower cylinder chamber 19L is returned to the two-way piston pump 31 through the pipe 41, the counter balance valve 43 and the pipe 47. The working fluid is further supplied to the upper cylinder chamber 19U of the hydraulic cylinder 13R through the pipe 29. Accordingly, the piston 19R moves downward and the upper table 5U moves downward, whereby the bending process is executed.

Even in this case, the moving speed of the upper table 5U is determined on the basis of two different paths in the same manner as that of rapidly moving downward, and in the case that the difference is equal to or more than a predetermined amount, the working is immediately stopped.

In this case, since across-sectional area in a lower surface side of the piston 19R is smaller than that in an upper surface side, an amount of the working fluid returning to the two-way piston pump 31 from the lower cylinder chamber 19L is less than an amount of the working fluid injected into the upper cylinder chamber 19U, so that the working fluid is supplemented from the oil tank 27 via the check valve 51.

In the case of inverting the hydraulic cylinder 13R so as to move the upper table 5U upward, the AC servo motor 39 is rotated in an opposite direction on the basis of an inverting command so as to reverse rotate the two-way piston pump 31. The working fluid supplied from the upper cylinder chamber 19U in a state in which the piston 19R moves downward is supplied to the lower cylinder chamber 19L through the pipe 29, the two-way piston pump 31, the pipe 47, the switch valve 45 and the pipe 41. Accordingly, the piston 19R moves upward and the upper table 5U starts moving upward.

Even in this case, the moving speed of the upper table 5U is determined on the basis of two different paths in the same manner as that of the cases of rapidly moving downward and the bending process, and in the case that the difference is equal to or more than a predetermined amount, the working is immediately stopped.

In this case, when the pressure of the working fluid injected into the lower cylinder chamber 19L becomes higher than a predetermined value, the prefill valve 23 is opened on the basis of a pilot signal 73, and the working fluid is fed to the oil tank 27 from the upper cylinder chamber l9U through the prefill valve 23.

According to the results mentioned above, the position of the upper table 5U is directly detected and the moving speed of the upper table 5U is determined on the basis of the change of the detected position. The ram moving speed is determined on the basis of the amount of the working fluid supplied to the upper cylinder chamber 19U or the lower cylinder chamber 19L in the hydraulic cylinder 13R. The working is immediately stopped in the case that it is judged that the abnormality exists, by comparing both of the ram moving speeds. Accordingly, if one ram moving speed monitor is out of order, another ram moving speed monitor is operated, so that it is possible to secure a safety of the operation.

Further, it is possible to immediately detect if a software program malfunctions, and it is possible to maintain safety in the operation.

In this case, this invention is not limited to the embodiment mentioned above, and can be carried out according to other aspects by applying a suitable change. That is, in the embodiment mentioned above, the description is given of the press brake 1 in which the upper table 5U is moved vertically, however, just the same structure is applied to a press brake in which the lower table 5L is moved vertically.

Next, a description will be given of a fourth embodiment according to the present invention. The fourth embodiment corresponds to an improvement of the second embodiment.

Figure 4:
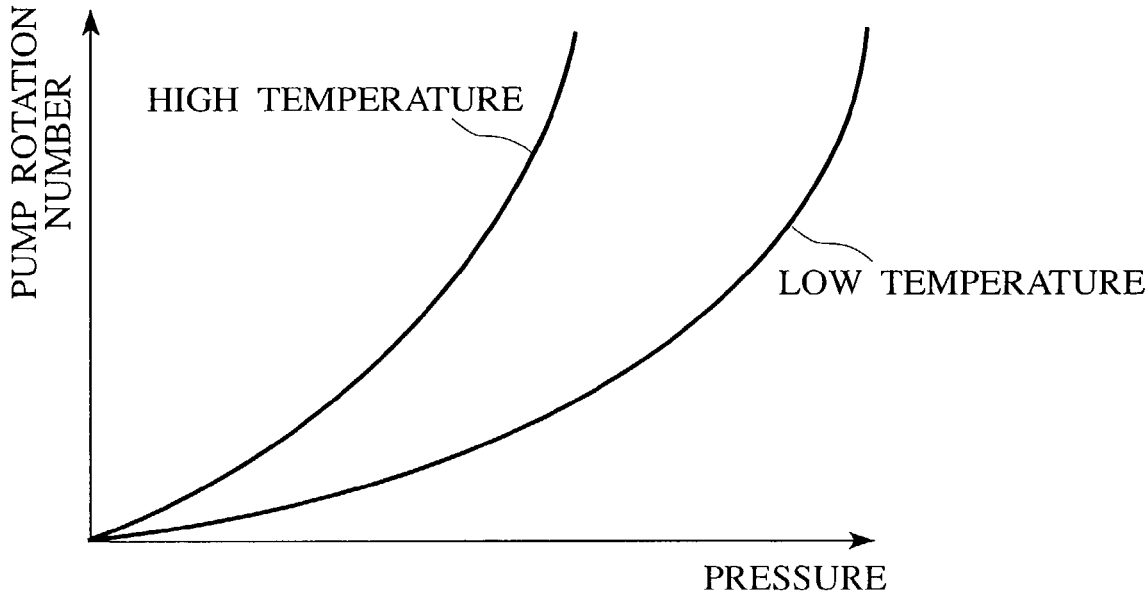
FIG. 4 is a graph showing a relationship of a pump rotational number with respect to an oil temperature and a pressure in the press brake, according to an exemplary embodiment of the present invention.

That is, in the second embodiment, as shown in a pump efficiency zero property in FIG. 4, it is necessary to rotate the hydraulic pump 217 in order to keep the upper table 203U at a fixed position since an oil leakage is generated in the hydraulic pump 217. However, as shown in FIG. 4, since the rotational number of the hydraulic pump 217 becomes different in correspondence to the pressure and the oil temperature of the working fluid, there is a problem that it is impossible to position the upper table 203U at a commanded position.

Accordingly, a description will be in detail given below of the fourth embodiment which improves the problem mentioned above.

FIGS. 5 and 6 show a press brake 301 according to this invention. This press brake 301 has, in the same manner as that of the second embodiment, side plates 3L and 3R provided in left and rights sides in a standing manner. This press brake 301 also has an upper table 5U on upper front end surfaces of the side plates 3L and 3R in such a manner as to be capable of moving vertically. This press brake is also provided with a lower table 5L on lower front surfaces of the side plates 3L and 3R.

In this case, an oil temperature sensor 319, which detects an oil temperature of the working fluid, and a pressure sensor 321, which detects the pressure, are mounted to the hydraulic cylinders 13L and 13R. Since the other portions are the same as the second embodiment, detailed descriptions will be omitted.

Next, a description will be given of a hydraulic circuit with respect to the hydraulic cylinders 13L and 13R with reference to FIG. 9. In this case, since the same hydraulic circuit is provided with respect to the left and right hydraulic cylinders 13L and 13R, a description will be given below of the right hydraulic cylinder 13R and the right hydraulic circuit.

An upper cylinder chamber 323U of the hydraulic cylinder 13R is connected to a prefill valve 327 through a pipe 325, and is further connected to an oil tank 331 through a pipe 329.

Further, the upper cylinder chamber 19U is connected to one side of a two-way piston pump 335 through a pipe 333. A pipe 337 is connected to the pipe 333 in the middle thereof, and is connected to the oil tank 331 via a check valve 339 and a suction filter 341. In this case, the two-way piston pump 335 is rotated and driven by an AC servo motor 343.

A pipe 345 is connected to the lower cylinder chamber 323L of the hydraulic cylinder 13R, and a counter balance valve 347 and a sequence switch valve 349 corresponding to an electromagnetic poppet valve are provided in parallel. The counter balance valve 347 and the sequence switch valve 349 are connected to another side of the two-way piston pump 335 through a pipe 351. Further, a pipe 353 is connected to the pipe 351 in the middle thereof, and this pipe 353 is connected to the oil tank 331 via a check valve 355 and a suction filter 357.

Further, a throttle valve 359 and a high pressure preference type shuttle valve 361 are provided between the pipe 345 and the pipe 333. A pipe 363 is connected to a discharge side of the high pressure preference type shuttle valve 361, and a relief valve 365 and a pipe 367 is connected to the oil tank 331.

A controller 369 controls the AC servo motor 343 which rotates and drives the two-way piston pump 335. The controller 369 has a position command portion 371 which commands the position of the upper table 5U, and a ram motion gain determining portion 375 is connected to the position command portion 371 via an adder 373. Further, the ram motion gain determining portion 375 is connected to the AC servo motor 343 via an amplifier 377 so as to send a command.

Further, a position counter 379, which receives the position signal of the upper table 5U from the linear scale 11 and which detects an actual position, is connected to the adder 377, thereby constituting a servo loop by which the actual position of the upper table 5U is fed back.

Further, a monitoring portion 381 is provided which receives the detection signals output from the oil temperature sensor 319 and the pressure sensor 321. The monitoring portion 381 monitors the pressure and the oil temperature and corrects the position signal of the upper table 5U, whereby the command signal output from the ram motion gain determining portion 375 is corrected.

Figure 10:
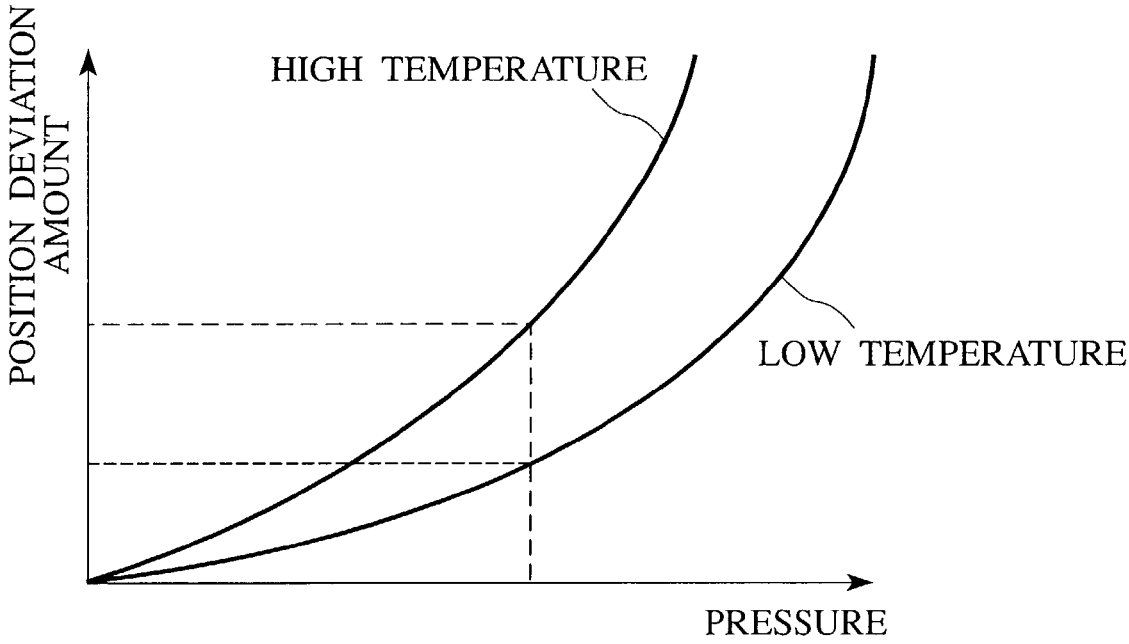
FIG. 10 is a graph showing a relationship of a position deviation amount with respect to a pressure and an oil temperature of a working fluid.

This monitoring portion 381 is connected to a memory 383, and a property of the pump with respect to the pressure and the oil temperature and a relationship with respect to a ram position deviation amount are stored in this memory 383, as shown in FIG. 10. Accordingly, the monitoring portion 381 determines a ram position deviation amount from the memory 383 on the basis of the pressure output from the pressure sensor 321 and the oil temperature output from the oil temperature sensor 319. The monitoring portion corrects the position command by setting the position deviation amount to a compensation value. This corrected command value is provided to the AC servo motor 343.

According to the structure mentioned above, in the case of rapidly moving the upper table 5U downward due to its own weight and by means of the hydraulic cylinder 13R, from a state in which the working fluid is charged into the upper cylinder chamber 323U and the lower cylinder chamber 323L, the two-way piston pump 335 is stopped and the piston 15R is in a top dead center, the pipe 345 is communicated with the pipe 351 by switching the sequence switch valve 349, and the two-way piston pump 335 is rotated by the AC servo motor 343.

Figure 9:
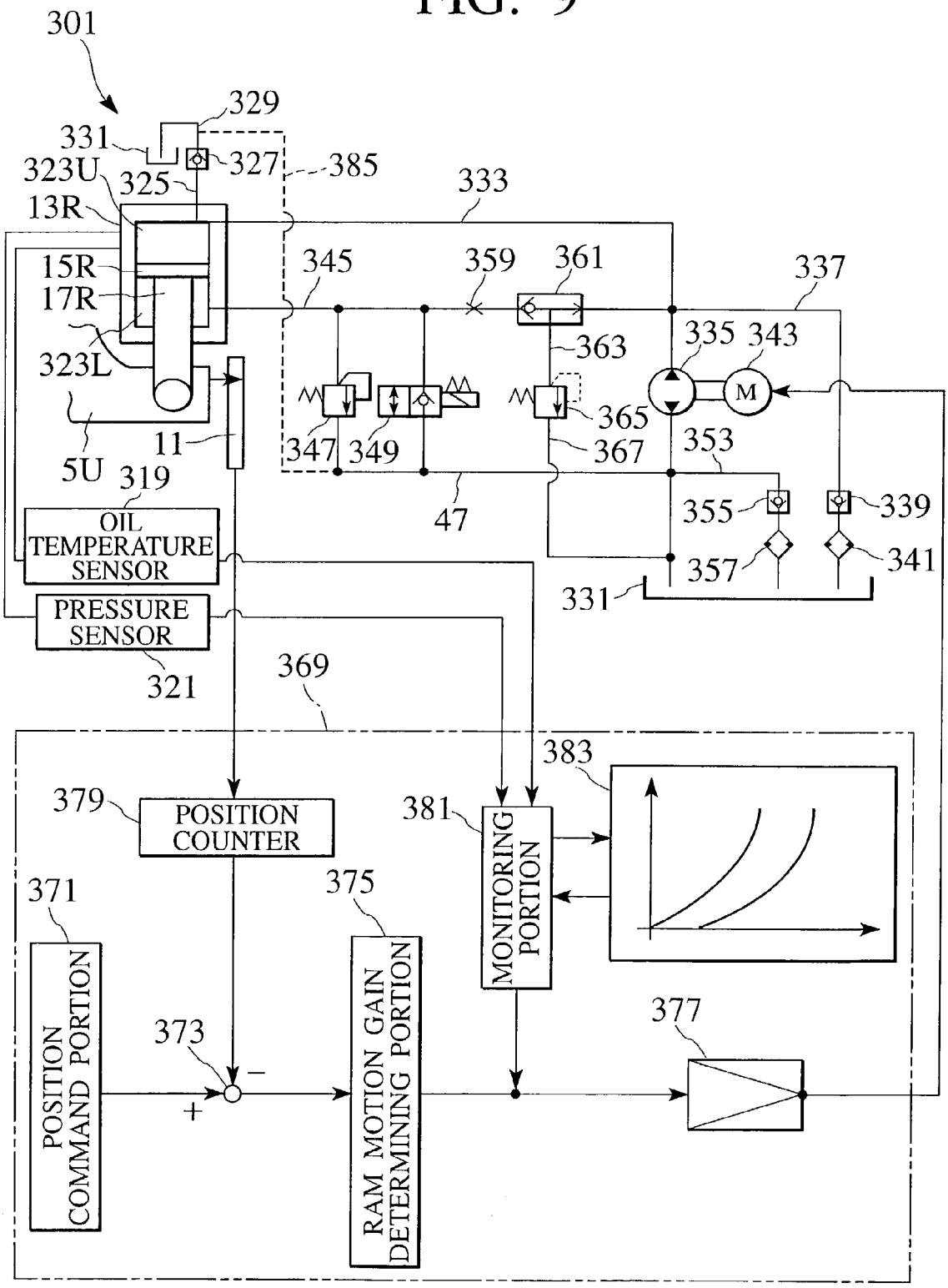
FIG. 9 is a block diagram showing a ram position controller using a hydraulic cylinder and a hydraulic circuit, according to an exemplary embodiment of the present invention.

In the case of moving further downward so as to execute the bending process, the sequence switch valve 349 is set to a state shown in FIG. 9, and the working fluid supplied from the lower cylinder chamber 323L is returned to the two-way piston pump 335 through the pipe 345, the counter balance valve 347 and the pipe 361. The working fluid is further supplied to the upper cylinder chamber 323U of the hydraulic cylinder 313R through the pipe 333. Accordingly, the piston 15R moves downward and the upper table 5U moves downward, whereby the bending process is executed.

In this case, since a cross sectional area in a lower surface side of the piston 15R is smaller than that in an upper surface side, an amount of the working fluid returning to the two-way piston pump 335 from the lower cylinder chamber 323L is less than an amount of the working fluid injected into the upper cylinder chamber 323U, so that the working fluid is supplemented from the oil tank 331 via the check valve 355.

In the case of moving the upper table 5U upward, the sequence switch valve 49 is switched to the state shown in FIG. 9, and the AC servo motor 343 is rotated in an opposite direction on the basis of an inverting command output from the position command portion 371 so as to reverse rotate the two-way piston pump 335. The working fluid supplied from the upper cylinder chamber 323U, in a state in which the piston 15R moves downward, is supplied to the lower cylinder chamber 323L through the pipe 333, the two-way piston pump 335, the pipe 351, the sequence switch valve 349 and the pipe 345. Accordingly, the piston 15R moves upward and the upper table 5U moves upward.

In this case, when the pressure of the working fluid injected into the lower cylinder chamber 323L becomes higher than a predetermined value, the prefill valve 327 is opened on the basis of a pilot signal 385, and the working fluid is fed to the oil tank 331 from the upper cylinder chamber 323U through the prefill valve 327.

Further, at a time of positioning the upper table 5U at the fixed position, the ram motion gain determining portion 375 determines the ram motion gain on the basis of the position command of the position command portion 371 and the position signal output from the linear scale 11, and the monitoring portion 381 monitors the oil temperature output from the oil temperature sensor 319 and the pressure output from the pressure sensor 321. The monitoring portion 381 determines the ram position deviation amount on the basis of the data stored in the memory 383, corrects the position command so as to amplify by the amplifier 377, and outputs the command to the AC servo motor 343.

According to the results mentioned above, it is possible to accurately position the upper table 5U at the predetermined position without being affected by the pressure and the oil temperature of the working fluid.

In this case, this invention is not limited to the embodiments mentioned above, and can be carried out according to other aspects by applying a suitable change. That is, in the embodiments mentioned above, the description is given of the press brake 1 in which the upper table 5U is moved vertically, however, the same structure may be applied to a press brake in which the lower table 5L is moved vertically.

The invention claimed is:

1. A method of monitoring ram speed, the method comprising:

moving a ram by moving a hydraulic cylinder according to a rotational direction of a two-way fluid pump;

detecting a position of the ram to determine a first ram moving speed based on a change of ram position;

detecting a rotational speed of a servo motor which drives the two-way fluid pump so as to compute a second ram moving speed based on a moving speed of the hydraulic cylinder which moves the ram; and comparing the first ram moving speed with the second ram moving speed and judging when the speeds differ by a predetermined amount.

2. The method recited in claim 1, wherein an amount of a working fluid discharged from the two-way fluid pump is computed based on the detected rotational speed of the servo motor.

3. The method recited in claim 1, wherein the servo motor is controlled to stop a bending process when the speeds differ by the predetermined amount.

4. A press brake that monitors a ram speed, the press brake comprising:

a movable ram;

a hydraulic cylinder that moves the ram;

a two-way fluid pump that operates the hydraulic cylinder so as to move the ram;

a ram position detector that detects a position of the ram;

a servo motor rotational speed detector that detects a rotational speed of a servo motor which rotates and drives the two-way fluid pump; and a controller that controls the servo motor, wherein the controller comprises:

a first speed processor that computes a first ram moving speed based on a position signal output from the ram position detector;

a second speed processor that computes a second ram moving speed based on a signal output from the servo motor rotational speed detector;

a comparator that compares the first ram moving speed with the second ram moving speed; and a judging portion that judges when the ram moving speeds differ by a predetermined amount so as to control the servo motor to stop a bending process.

5. A method of controlling ram position, the method comprising:

rotating a servo motor based on a position command;

operating a hydraulic pump by the servo motor;

moving a ram using a hydraulic cylinder operated by a working fluid supplied from the hydraulic pump;

feeding back a position signal output from a ram position detector which detects a position of the ram;

determining a position compensation value based on a predetermined relationship of a deviation amount of the ram position with respect to a pressure and an oil temperature in the hydraulic cylinder; and obtaining a corrected position command based on the position compensation value, and rotating the servo motor based on the corrected position command.

6. The method recited in claim 5, wherein the ram is provided in a press brake; and wherein a bending process is applied to a work based on a cooperation between a punch and a die which are provided in the ram.

7. A ram position controller, comprising:

a servo motor;

a hydraulic pump that operates the servo motor;

a hydraulic cylinder that is operated by a working fluid supplied from the hydraulic pump;

a ram that is moved by the hydraulic cylinder;

a position command portion that controls a position of the ram;

a ram position detector that detects and feeds back the position of the ram;

a memory that stores a relationship between a pressure and an oil temperature in the hydraulic cylinder and a ram position deviation;

a pressure sensor provided in the hydraulic cylinder;

an oil temperature sensor provided in the hydraulic cylinder; and a monitoring portion that monitors a pressure sensed by the pressure sensor and an oil temperature sensed by the oil temperature sensor, and that determines a ram position deviation amount according to the relationship stored in the memory between the pressure and the oil temperature in the hydraulic cylinder and the ram position deviation.

8. The ram position controller recited in claim 7, wherein the ram is provided in a press brake; and wherein the ram includes a punch and a die that cooperate to perform a bending process on a work.

* * * * *